US006960976B2

(12) United States Patent
Fan

(10) Patent No.: US 6,960,976 B2
(45) Date of Patent: Nov. 1, 2005

(54) FERRITE CORED COIL STRUCTURE FOR SMD AND FABRICATION METHOD OF THE SAME

(76) Inventor: Yun-Kuang Fan, No. 9, Gau Cherng 9 St., Ba Der City, Taoyuan (TW)

( * ) Notice: Subject to any disclaimer, the term of this patent is extended or adjusted under 35 U.S.C. 154(b) by 80 days.

(21) Appl. No.: 10/687,660

(22) Filed: Oct. 20, 2003

(65) Prior Publication Data

US 2004/0080391 A1 Apr. 29, 2004

Related U.S. Application Data

(63) Continuation-in-part of application No. 10/151,145, filed on May 21, 2002, now Pat. No. 6,680,664.

(51) Int. Cl.[7] ..... H01F 27/02
(52) U.S. Cl. ..... 336/83; 336/200; 336/192
(58) Field of Search ..... 336/65, 83, 192, 336/200

(56) References Cited

U.S. PATENT DOCUMENTS 5,307,557 A * 5/1994 Te-Hsueh ..... 29/605
6,157,283 A * 12/2000 Tsunemi ..... 336/192
6,292,083 B1 * 9/2001 Tajima et al. ..... 336/192
6,486,763 B1 * 11/2002 Kummel ..... 336/96
6,535,094 B2 * 3/2003 Murata et al. ..... 336/83
6,566,993 B1 * 5/2003 Otsuka et al. ..... 336/83

FOREIGN PATENT DOCUMENTS

JP 63-029912 * 2/1988
JP 53-169006 * 7/1988
JP 64-054715 * 3/1989

* cited by examiner

*Primary Examiner*—Tuyen T Nguyen
(74) *Attorney, Agent, or Firm*—Rosenberg, Klein & Lee

(57) ABSTRACT

The ferrite cored coil structure for SMD of the present invention, has two studs each protruded out of the right and the left sides of the core body for engaging with a conductor plate provided on a conducting bracket, and then both ends of the core body are respectively enclosed to form an insulation block. On the other hand, the unenclosed portion of the core body is wound with a string of conductor to form several coils, then both terminals of the coil are soldered to emerge conductor plate terminals thereby forming a wound type inductor element for SMD. The fabrication method is not only able to simplify complicated steps involved in the conventional technique, but also causes it possible for mass production. The assembled structure can be laid horizontally to save space when being equipped with associated components in an electronic device. The invention also discloses the step of fabrication method.

5 Claims, 8 Drawing Sheets

FERRITE CORED COIL STRUCTURE FOR SMD AND FABRICATION METHOD OF THE SAME

CROSS-REFERENCES TO RELATED APPLICATIONS

The present invention is a Continuation-in-part (CIP) application of a pending non-provisional patent application with application Ser. No. 10/151,145 filed May 21, 2002 now U.S. Pat. No. 6,680,664.

BACKGROUND OF THE INVENTION

1. Field of the Invention

The present invention relates to a ferrite cored coil structure for SMD, and fabrication method of the same, and more particularly, to an innovative ferrite cored coil structure for SMD (surface mounting device) in which a stud is protruded out of each of the two ends thereof and associated with a conducting bracket, and the fabrication of the same involves molding technology and punching technology.

2. Description of the Prior Art

FIG. 1(A) shows a ferrite cored coil structure for SMD fabricated according to the conventional technique. As shown in FIG. 1(A), an Ag—Pd alloy is electroplated on the bottom surface 811 of a ferrite core 81 to form two electrodes 812, and the two terminals 821 of a coil 82 wound around the core 81 are fastened thereat by electroplating such that fabrication of the ferrite cored coil structure for SMD 8 is accomplished. However, the ferrite cored coil structure for SMD fabricated as such is disadvantageous owing to the fact that the Ag—Pd alloy used for electroplating is quite expensive, and the treatment of waste water produced by electroplating to meet the requirement of standards for environmental protection is rather difficult to attain. Should the treatment of waste water be incomplete, an immediate impact to the environmental ecological state could not be avoided.

FIGS. 1(B) and 1(C) show another ferrite cored coil structure 9 for SMD fabricated according to the conventional technique. As shown in FIGS. 1(B) and 1(C), a coil 92 is wound around a fabricated ferrite core 91 which is adhered to a base 93 having an electrode 931 with an AB binder so as to form a ferrite cored coil structure 9 for SMD. The ferrite cored coil 9 fabricated as such can do without using Ag—Pd alloy. However, using an extra base causes the increase of the volume and height of the product resulting in increasing the production cost due to complicated fabrication process.

In view of the above mentioned shortcomings inherent to the conventional fabrication technique, the inventor of the present invention disclosed an innovated fabrication technique (refer to Taiwan Pat. No. 458351) shown in FIG. 1(D). The invention effectively rectified the shortcomings inherent to the conventional technique and made it possible for promoting mass production, reducing the production cost and eliminating problematic environmental contamination. However, the invention still remains some disadvantages to be overcome. For example, the stand type SMD structure results in excessive product height that is not well fitted for installing in thin and tiny electronic devices whose available inner space is usually limited.

It is what the reason the inventor has put forth every effort for years by continuous research and experimentation attempting to find out remedies to palliate the inherent shortcomings of every conventional technique including my own previous invention described above, and at last has succeeded in coming out with the present invention.

SUMMARY OF THE INVENTION

It is an object of the present invention to provide a ferrite cored coil structure for SMD, wherein two contact terminals are emerged out of the structure and cambered to rest at each side of the insulated portion of the cored coil structure horizontally and symmetrically with each other so that the structure can be laid horizontally thereby facilitating assembling with its associated components in a limited available space of the electronic device.

It is another object of the present invention to provide a ferrite cored coil structure for SMD in which a stud is protruded out of each of the two ends thereof and associated with a conducting bracket, and molding technology and punching technology are then applied for fabrication of the same without need of electroplating process so as to avoid environmental contamination.

It is one more object of the present invention to provide the fabrication method of said ferrite cored coil structure for SMD by illustrating in detail steps.

To achieve these and other objects mentioned above, the ferrite cored coil structure of the present invention has two studs each protruded out of the right and the left sides of the core body for engaging with a conductor plate provided on the conducting bracket, and then both ends of the core body are respectively enclosed to form an insulation block. On the other hand, the unenclosed portion of the core body is wound with a string of conductor to form several coils, then afterwards both terminals of the coil are soldered to emerge terminals of the conductor plates thereby forming a wound type inductor element for SMD. The fabrication method of the same provided by the present invention is not only able to simplify complicated fabrication steps involved in the conventional technique, but also causes it possible for mass production. Meanwhile, the assembled structure of the present invention can be laid horizontally that contributes to saving space when being equipped with associated components in an electronic device.

For fuller understanding of the nature and objects of the present invention, and detailed steps about fabrication method of the same, reference should be made to the following detailed description taken in conjunction with the accompanying drawings.

BRIEF DESCRIPTION OF THE DRAWINGS

The drawings disclose the illustrative embodiments of the present invention which serves to exemplify the various advantages and objects hereof, and are as follows.

DETAILED DESCRIPTION OF THE PREFERRED EMBODIMENTS

Figure 1:
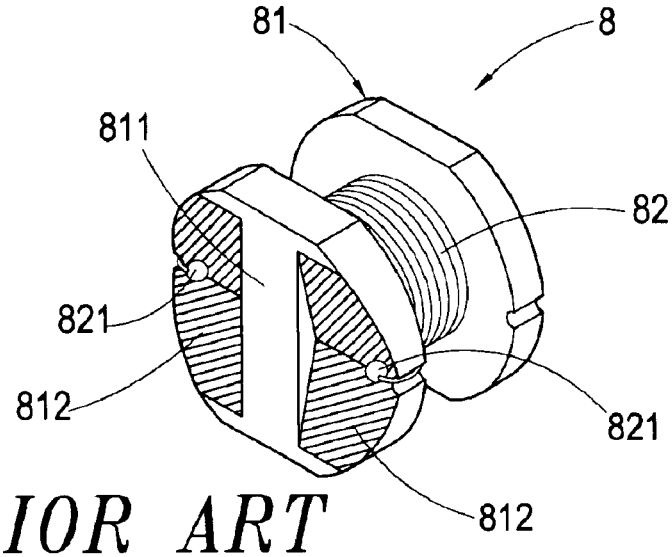
PRIOR ART FIG.1 (A)
FIGS. 1(A) through 1(D) are schematic views of conventional ferrite cored coil structures.
Figure 1:
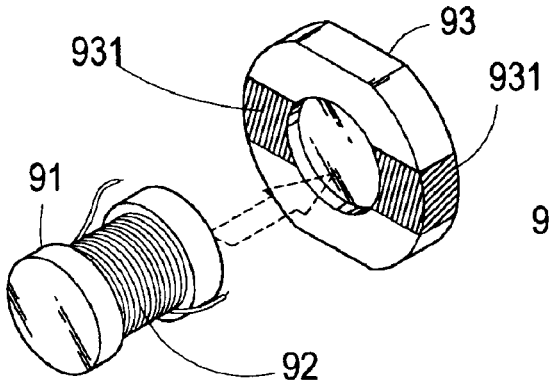
PRIOR ART FIG.1 (B)
Figure 1:
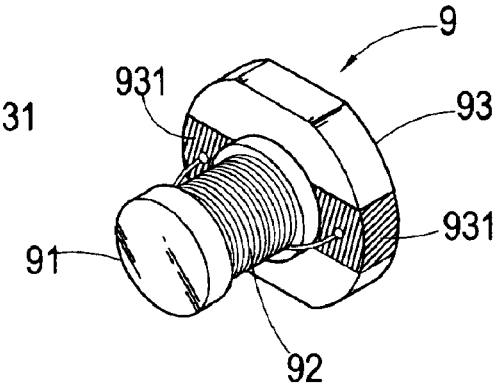
PRIOR ART FIG.1 (C)
Figure 1:
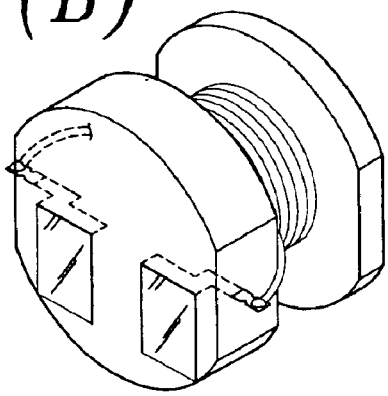
PRIOR ART FIG.1 (D)
Figure 2:
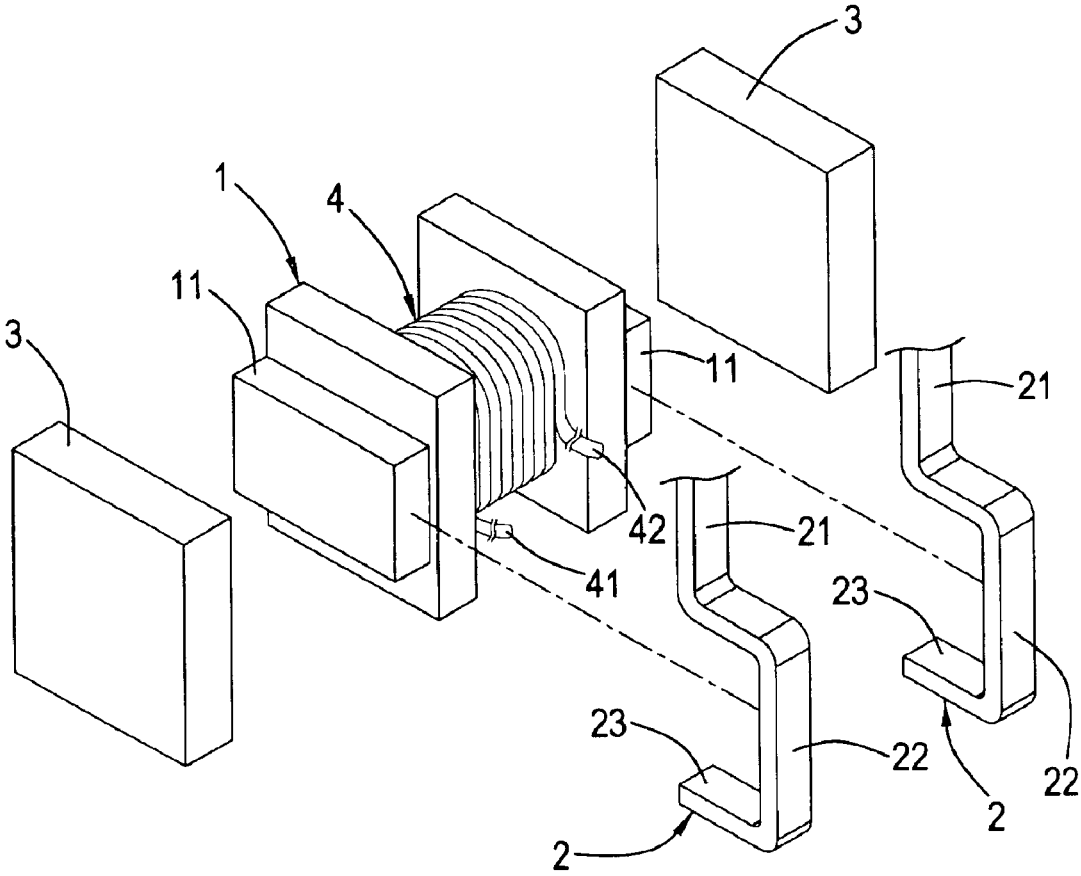
FIGS. 2(A) and 2(B) are respectively an illustrative exploded view and a three dimensional view of the present invention.
Figure 2:
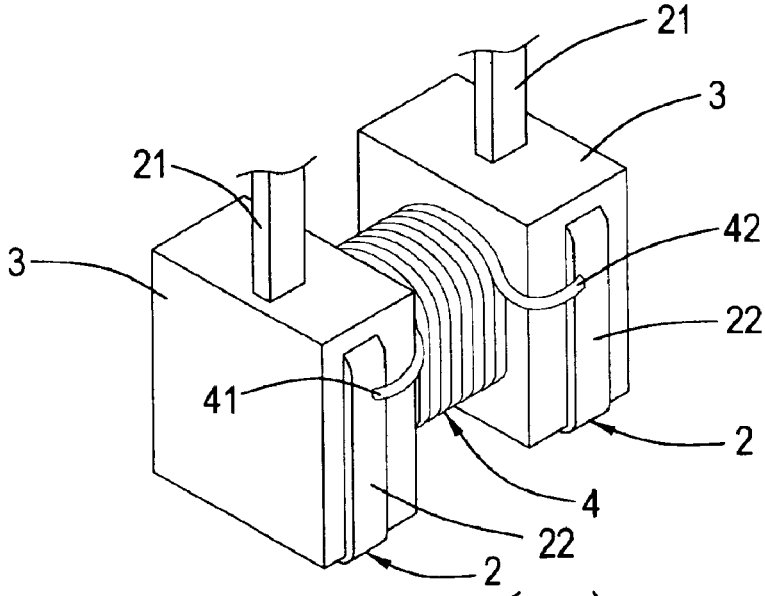

Referring to FIGS. 2(A) and 2(B), the ferrite cored coil structure for SMD according to the present invention is essentially composed of a core body 1, two conductor plates 2, two insulation blocks 3 and a coil 4.

The core body 1 is configured into an approximate H shape having two studs 11 each of them being protruded out of a side surface of the core body 1.

The conductor plates 2 has a contact terminal 21 at one end, and an extension conducting terminal 22 at the other end, the front tip portion of the conducting terminal 22 is cambered to form a detention portion 23 which and the conducting terminal 22 are each respectively fixed to and rests on one of the studs formed at both ends of the core body 1 firmly.'

Each of the two insulation blocks 3 is enclosed over one end portion of the core body 1 respectively to emerge only the conducting terminal 22 and the detention portion 23 of the conductor plate 2 out of its lateral surface. The insulation block 3 is made of an insulation material such as epoxy resin or the like. Before enclosing, the insulation material is heated to melt into liquid state so as to be easily enclosed over both end portions of the core body 1, the insulation material recovers its solid state to form into the insulation block 3 after being cooled down.

Figure 3:
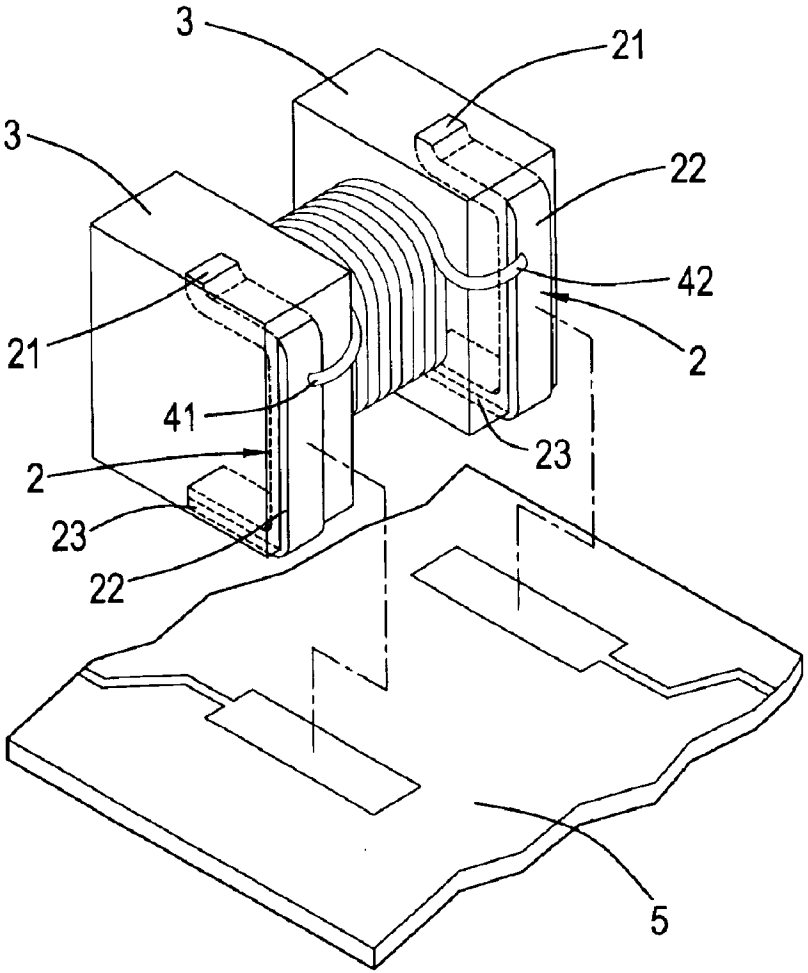
FIGS. 3(A) and 3(B) are the three dimensional illustrative views of the present invention attached with its substrate.
Figure 3:
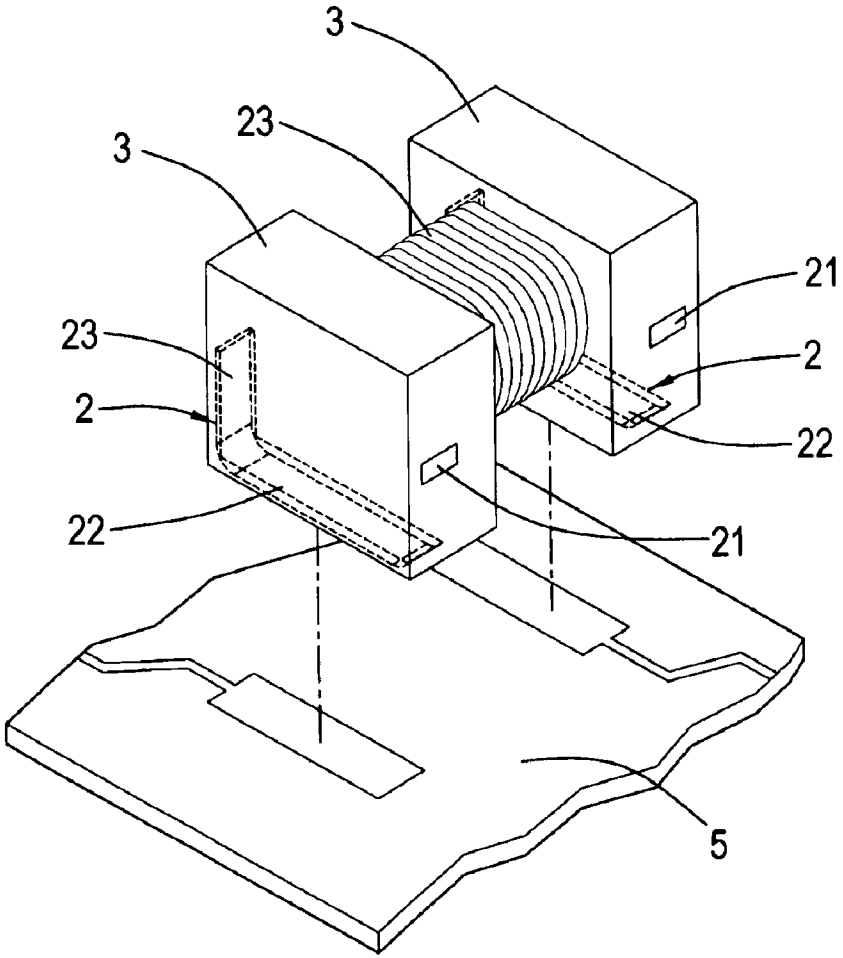
Figure 4:
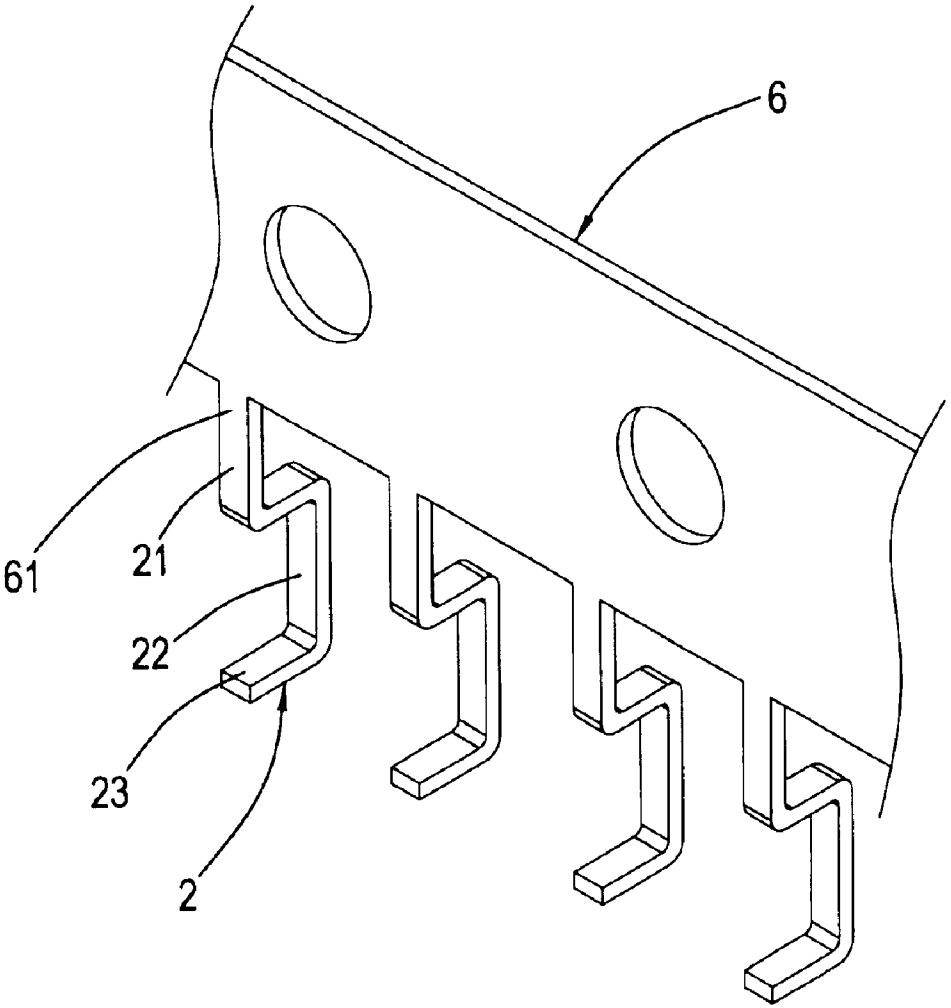
FIG. 4 is a schematic view of the conducting bracket included in the present invention.
Figure 5:
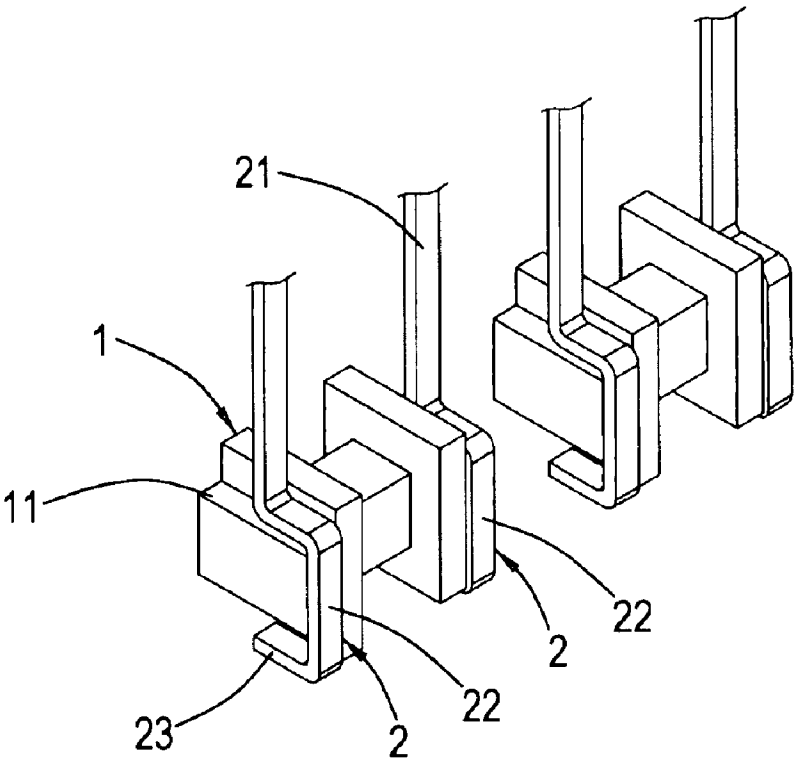
FIGS. 5(A) through 5(F) are schematic views illustrating fabrication steps of the present invention.
Figure 5:
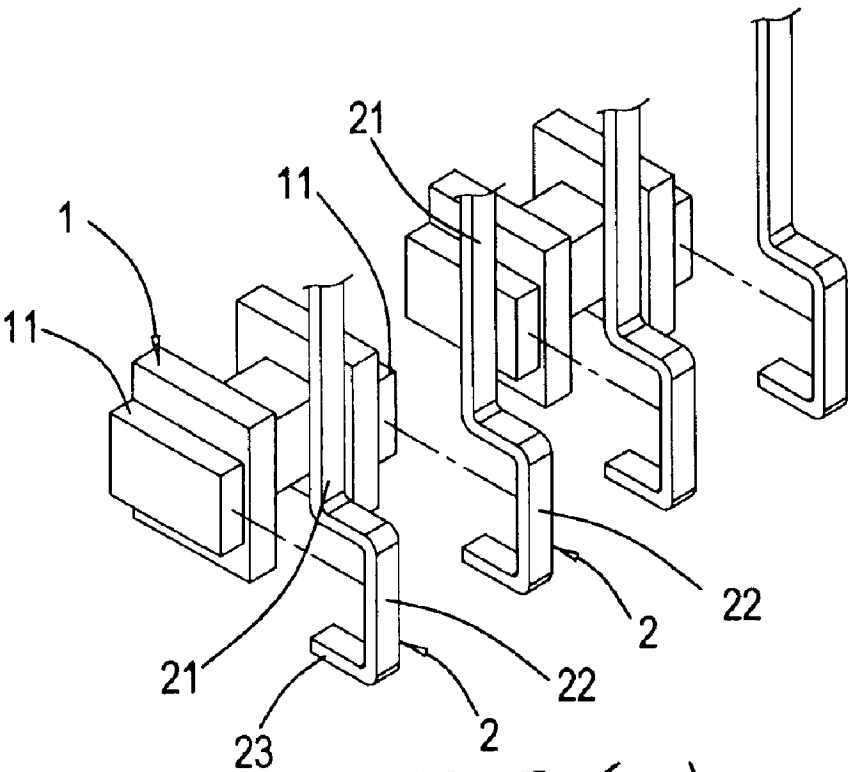
Figure 5:
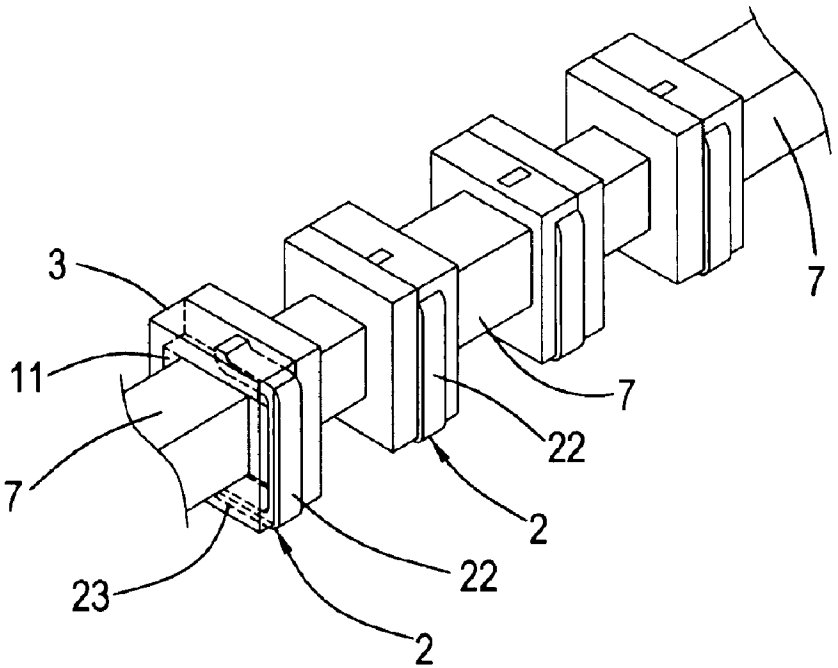
Figure 5:
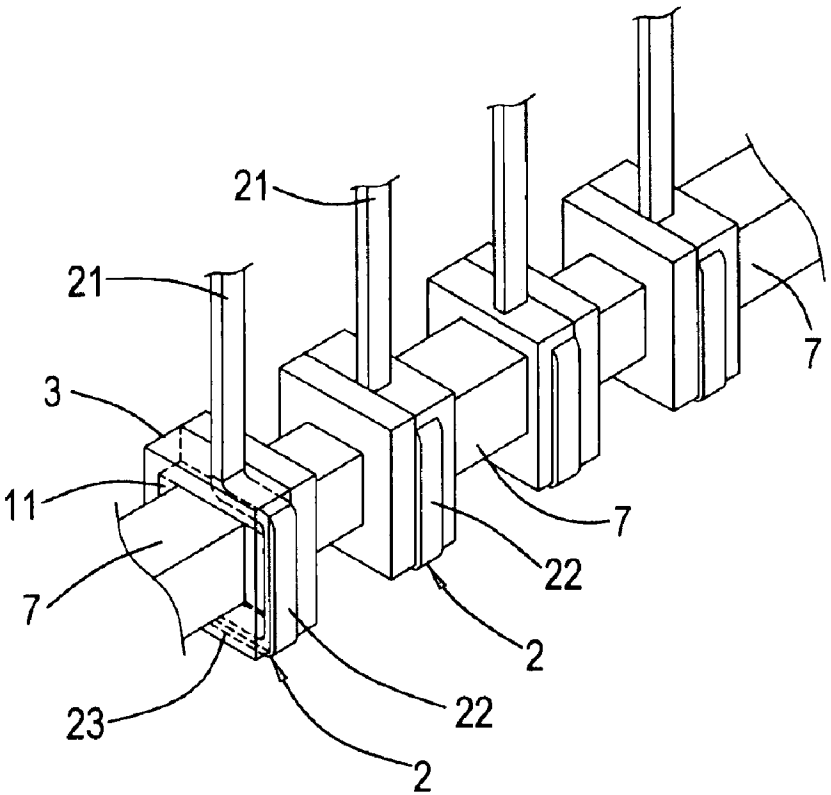
Figure 5:
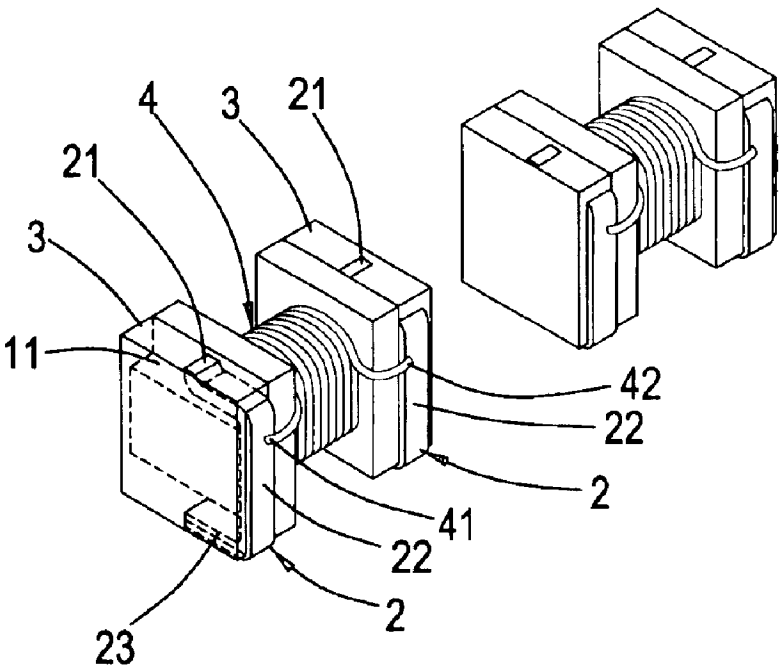
Figure 5:
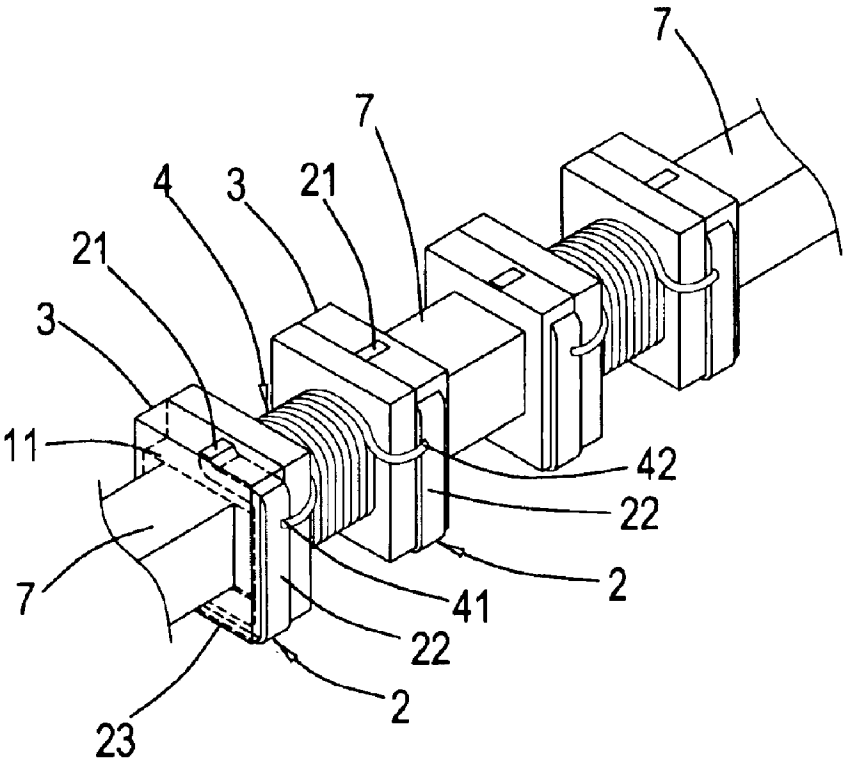

The coil 4 is an electrical conducting member formed with continuously and spirally wound conductor on part of the core body 1 where it is not enclosed with the insulation body 3 with its both terminals 41, 42 respectively connected to corresponding conducting terminals 22 of the conductor plate 2. The ferrite cored coil structure is laid horizontally when in operation so as to enable attaching a substrate 5 by SMD technology (see FIGS. 3(A),3(B)) thereby minimizing the occupied space by the substrate 5 as small as possible to utilize the limited available space in the electronic device effectively.

Referring to FIGS. 5(A) through 5(E), the fabrication method of the ferrite cored coil structure for SMD comprises the following steps:

Step 1: Restraining the conducting terminals 22 and the dention portions 23 of the conductor plate 2 both of them being symmetrically formed on two ends of a component unit 61 of a conducting bracket 6 on the studs 11 protruded from both ends of the ferrite cored coil 1.

Step 2: Enclosing two end portions of the cored coil 1 with the insulation blocks 3 by molding process in a mold, and emerging a connector portion 7 at each end. By so, both the conducting terminals 22 and the detention portions 23 of the conductor plates 2 are exposed at the lateral surfaces of the insulation block 3, then a plurality of core bodies 1 together with their insulation blocks 3 are connected in series via the connector portions 7 remaining the conducting terminals 22 and the detention portions 23 of the conductor plates to be retained on the studs 11 of the core body 1 thereby preventing the displacement or disengagement between the core body 1 and the conductor plate 2 during the insulation block 3 is going through the molding process.

Step 3: Punching down the contact terminals 21 of the conductor plate 2 emerging out of the insulation block 3 from the component unit 61 of the conducting bracket 6 by punching process.

Step 4: Forming the coil 4 with a string of conductor spirally wound on the portion of core body 1 where being not enclosed with the insulation block 3, and then connecting its two terminals 41, 42 respectively to the corresponding conducting terminals 22 of the conductor plate 2.

Step 5: Punching down the connector portion 7 emerging out of each end of the insulation block 3 by punching process.

Step 6: Finishing the fabrication of the ferrite cored coil structure for SMD.

With the above described fabrication method, the widely applicable ferrite cored coil structure for SMD is well suitable for mass production in effectively shortened time and with curtailed production cost.

Figure 6:
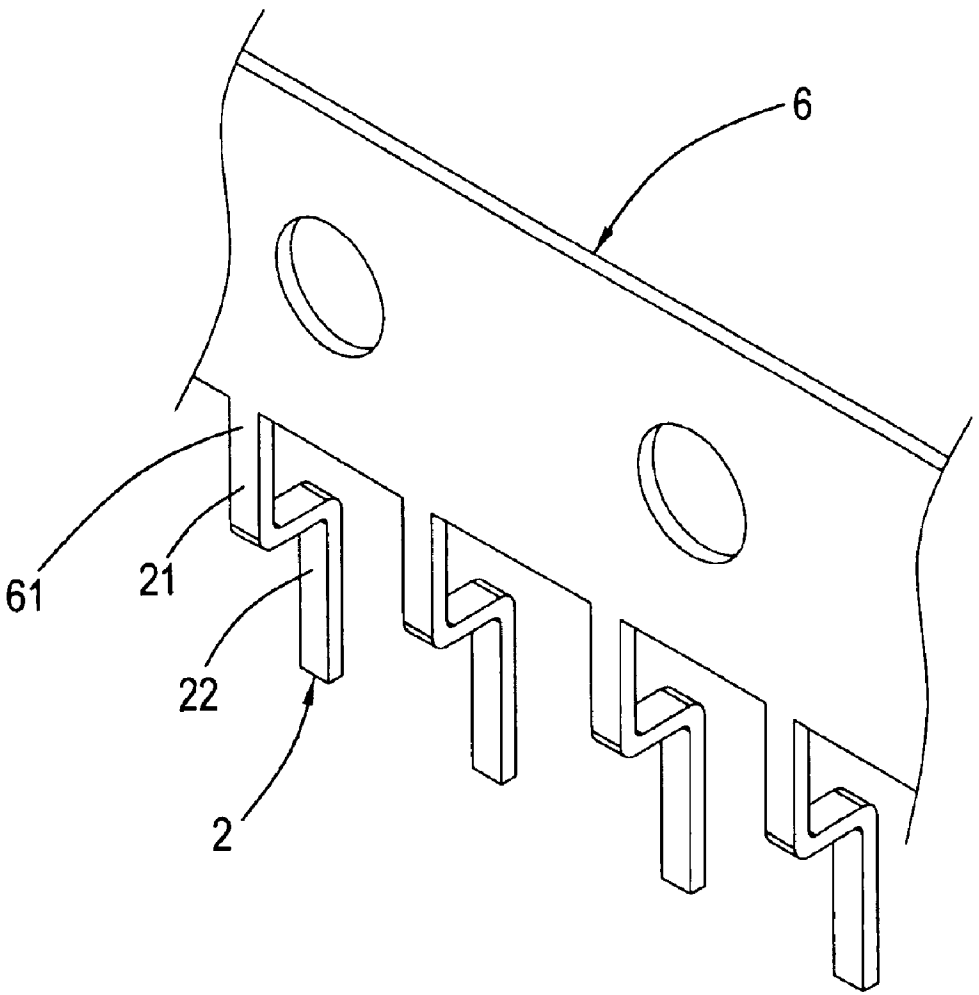
FIG. 6 is a schematic view of the conducting bracket in another embodiment.

Referring to FIG. 6, in another embodiment of the present invention, the detention portions 23 of the component unit 61 for the conducting bracket 6 are omitted, but alternatively, the conducting terminals 22 of the conductor plate 2 symmetrically formed at two ends of the component unit 61 for the conducting bracket 6 are restrained respectively by the studs 11 protruded out of the two ends of the core body 1. However, the ferrite cored coil structure for SMD which being constructed as such can also be fabricated according to the same steps as describe above.

It emerges form the description of the above example that the invention has several noteworthy advantages compared with the like products fabricated according to any conventional technique, in particular:

1. That the fabrication method is simple and suitable for mass production in short time with a curtailed production cost.

2. That the elimination of electroplating process is contributive to environmental protection.

3. That the compactness of the structure enables the ferrite cored coil to be assembled together with its associated components in a limited available space of an electronic device.

Many changes and modifications in the above described embodiments of the invention can, of course be carried out without departing from the scope thereof. Accordingly, to promote the progress in science and the useful arts, the invention is disclosed and is intended to be limited only by the scope of the appended claims.

What is claimed is:

1. A ferrite cored coil structure for SMD comprising:

a core body having two studs each of them being protruded out of a side surface of said core body;

two conductor plates having a contact terminal at one end, and an extension conducting terminal at the other end, the front tip portion of said conducting terminal being cambered to form a detention portion which and said conducting terminal being each respectively fixed to, and rests on one of said studs protruded from both ends of said core body;

two insulation blocks each of them being enclosed over one end portion of said core body respectively to emerge only said conducting terminal and said detention portion of said conductor plate out of its lateral surface, and;

a coil being formed with continuously and spirally wound conductor on part of said core body where being not enclosed with said insulation block.

2. The ferrite cored coil structure as in claim 1, wherein said detention portions are omitted, but alternatively, said conducting terminals of said conductor plate are restrained respectively by said studs protruded out of both ends of said core body.

3. The ferrite cored coil structure as in claim 1, wherein said insulation block is made of an insulation material such as epoxy resin.

4. The ferrite cored coil structure as in claim 2, wherein said insulation material is heated to melt into liquid state so as to be easily enclosed over both end portions of said core body, after being cooled down, said insulation material recovers its original solid state to form into said insulate block.

5. The ferrite cored coil structure as in claim 2, wherein both terminals of said coil are respectively connected to corresponding conducting terminals of said conductor plate.

* * * * *